United States Patent [19]

Smith

[11] 4,456,248

[45] Jun. 26, 1984

[54] EXERCISER FOR RUNNERS

[76] Inventor: Robert S. Smith, 1263 Emory St., San Jose, Calif. 95126

[21] Appl. No.: 327,869

[22] Filed: Dec. 7, 1981

[51] Int. Cl.[3] ..... A63B 21/00

[52] U.S. Cl. ..... 272/134; 272/DIG. 4; 272/145

[58] Field of Search ..... 272/62, 63, 120, 134, 272/143, 93

[56] References Cited

U.S. PATENT DOCUMENTS

| | | | |
|---|---|---|---|
| 2,425,971 | 8/1947 | Walker | 272/62 X |
| 2,759,730 | 8/1956 | Berry | 272/93 X |
| 3,521,881 | 7/1970 | Schaevitz | 272/93 |
| 4,046,373 | 9/1977 | Kim | 272/63 |
| 4,332,381 | 6/1982 | Lyons | 272/63 X |

OTHER PUBLICATIONS

"Universal Multi-Station Conditioning Machine"-Universal Exercise Equipment Catalogue Received in A.U.334, 8/4/80, see p. 9.

"Gym Doorway Bar"-Black Belt Magazine, Mar. 1973, p. 55.

*Primary Examiner*—Richard J. Apley
*Assistant Examiner*—William R. Browne
*Attorney, Agent, or Firm*—Alan H. MacPherson; Steven F. Caserza; Terrence E. Dooher

[57] ABSTRACT

An exercise apparatus comprising structure for performing exercises which includes a handbar for being grasped by the hands of a user, a bar for restraining the feet of the user and a padded member for restraining the thighs of the user, the padded member being adjustable in location relative to the structure for restraining the feet of the user such that said structure allows the user to stress the user's muscles in the range of motion where the greatest stress is imposed by an activity such as sprinting.

11 Claims, 8 Drawing Figures

FIG. 3
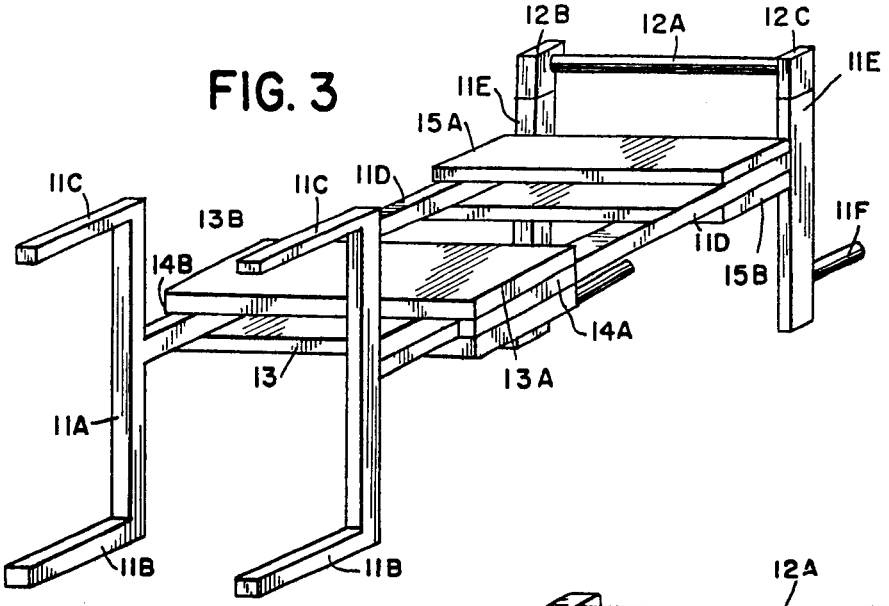
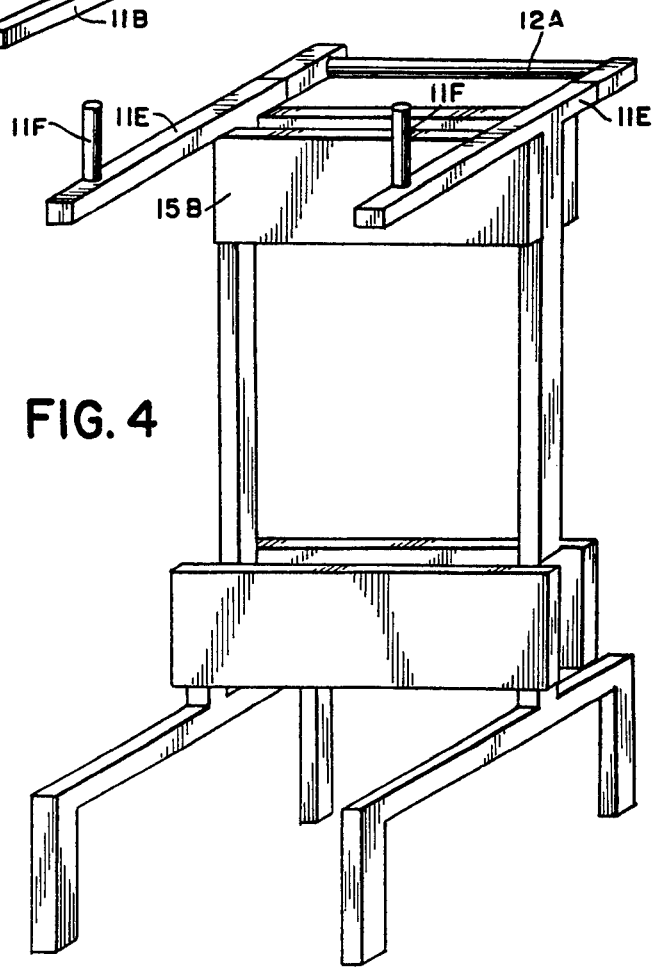
FIG. 4

EXERCISER FOR RUNNERS

FIELD OF THE INVENTION

This invention relates to exercise apparatus and particularly to apparatus for use in conditioning runners and sprinters.

BACKGROUND OF THE INVENTION

The use of machines, racks and various other types of devices for the purpose of exercising is old. Included among prior art exercise devices are platforms or benches for performing sit-ups, parallel bars for performing dips and weights. Exercise structures have evolved from the use of these devices primarily on a trial-and-error basis. In recent years, the trial and error approach to development of exercise structures has been giving way to more systematic studies conducted in a more scientific manner by researchers with strong academic backgrouds on appropriate groups, often times young men and women in schools and universities. From these studies have been identified certain principles that serve as guidelines for formulating programs intended to develop the body with specific objectives in mind. Some athletes aspire to be runners, other aspire to be swimmers, or wrestlers, etc. In general, manufacturers of exercise apparatus provide equipment with which one or more exercises can be performed without much regard to relating the value of an exercise to a specific activity. This is in spite of the fact that several important principles have come to be recognized as operative regarding the development of athletic prowess. Four of these principles are particularly germane to the objects of this invention:

1. The greatest rate of strength increase due to exercise is very specific to the range of motion in which the exercise is performed.

2. Rate of increase of strength is most rapid when a program of stress imposed by the exercise approaches the maximum capacity of the performer.

3. The rate of increase of running speed is most rapid when a program of strength building exercises is combined with speed building exercises.

4. Heavy resistance exercises, performed specifically in the range of motion where stress imposed by running is greatest, are very effective in protecting against injuries (to the hamstring, groin, Achilles' tendon, etc.)—often experienced by sprinters.

It is an object of this invention to provide an apparatus which enables the user to perform a number of exercises which particularly benefit the muscle groups involved in sprinting by applying adjustable resistance to the motion of said groups in the range of motion where stress in sprinting is greatest.

Maximum stress on the hamstring occurs when the foot strikes the ground almost directly under the center of gravity of the body. In the next instant, violent contractions of the hamstring and buttocks propel the body forward by pushing the foot backward. Thus, one important exercise to improve speed would involve contractions of the hamstring and buttocks when the hip is almost straight.

While the thrust with the hamstring is being performed, the muscles of the lower abdomen and upper part of the quadriceps of the same leg are relaxed and stretching to their fullest extent. At the instant the hamstring thrust is complete, and the foot is about to leave the ground, these stretched lower abdmoninal and upper quadricep muscles are suddenly called upon to contract in order to reverse the direction of the swing. From this consideration, it is apparent that a second important exercise would be one which causes contraction of the lower abdominal muscles when the back is arched. When one foot strikes the ground, the knee of the other leg starts its swing upward and forward. It is well known that the best sprinters have high knee action. Thrusting the kness as high as possible requires strong contraction of the abdominal muscles and quadriceps in that range of motion where the sprinter is in a jack-knife position. Stressed contractions with the body and legs "jack-knifed" is therefore a third important exercise.

Sprinting is a twisting action where the angular momentum generated by the hips and legs twisting in one direction is counter balanced by the arms and shoulders twisting in the opposite direction. Consequently, it is well recognized that total body strength including the arms and shoulders is important for top sprinters. Exercises for the arms and upper back in the aforedescribed ranges of motion can be performed with the apparatus of this invention.

As the muscle group becomes stronger, it is desireable to increase the resistance to motion of the exercise in accordance with the principle of maximum exertion for greatest rate of strength gain. Most exercise machines have means for lifting various amounts of weight to provide added resistance while others have springs, or use compressed air or hydraulics. Weights are expensive. Springs wear. Therefore, while the use of weights and springs together with said apparatus is intended to be an embodiment of this invention, a preferred embodiment will be presented which uses the weight of the apparatus and the performer with adjustable leverage to apply variable resistance.

The most effective way to reach the market with this type of equipment is by mail orders generated by TV or news advertisements or by consigning large numbers to chain stores. Therefore, the preferred situation in the interest of reducing shipping and storage costs is to sell the apparatus dissembled and packaged in compact containers. This requires that the buyer be able to assemble the apparatus with a few common tools and that the apparatus be very sturdy for this purpose.

It is therefore a further objective of this invention that said apparatus be capable of being packaged in a compact flat package and easily assembled by the user.

SUMMARY

In accordance with this invention, an apparatus is provided upon which may be performed exercises and which imposes resistance in that range of motion where great stress is experienced in sprinting. The apparatus may be used in a prone position by a person who is either prone or vertical to perform one group of exercises or in an erect position by an erect person to perform another group of exercises. In one embodimnt, resistance to the exercise motion is imposed by a lever where the resistance may be adjusted by adjusting the position of a sliding seat and the length of the lever arm. In its preferred embodiment, the apparatus consists of flat frame sections and panels that may be packaged in flat compact containers for economy in shipping and storing.

BRIEF DESCRIPTION OF DRAWINGS

FIG. 3 shows the assembled apparatus in one embodiment of the invention wherein the apparatus lies in the prone position.

FIG. 4 shows the same apparatus in the erect position.

DETAILED DESCRIPTION

Turning now to a more detailed description of the invention, there is presented in FIGS. 1*a* through 1*h* a series of views of a sprinter in full stride.

Figure 1:
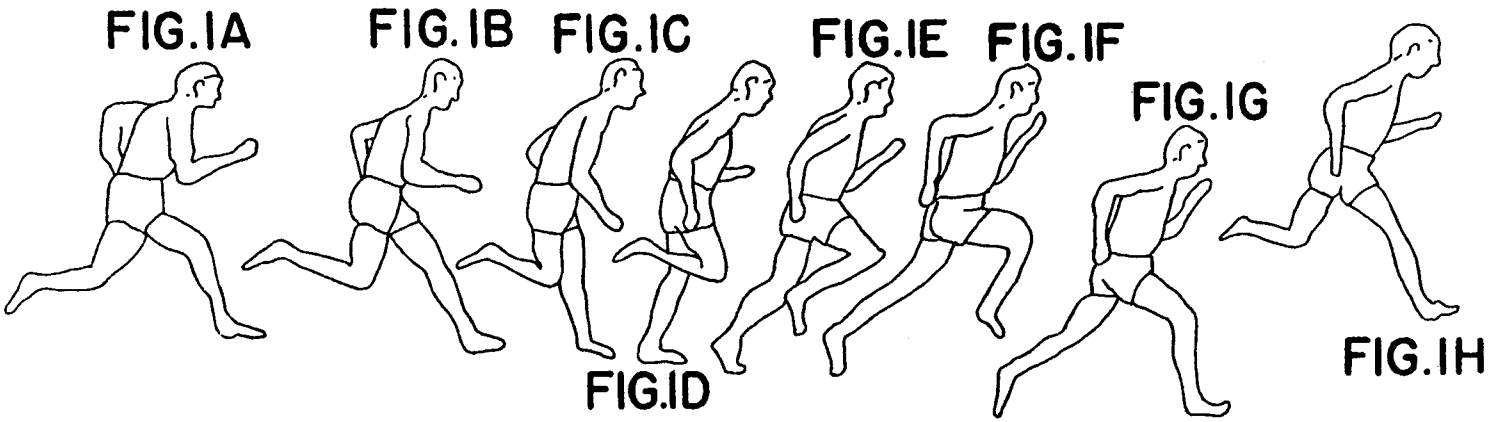
FIGS. 1*a* through 1*h* are a series of views of a sprinter in full stride from which may be deduced the range of motion where stress imposed on a particular muscle group is greatest.

These Figures show that the left foot strikes the ground to initiate hamstring contraction when the hip is nearly straight. (FIG. 1*c*). When the leg and back are arched, the leg reversed direction of swing by means of a vigorous contraction of the lower abdomen (groin) muscles as shown in FIG. 1*a:* the knee is thrust as high as possible by severe contraction of the abdominal muscles and quadriceps when the hip is in the jack-knife position. (FIG. 1*f*). FIGS. 1*a* through 1*h* also illustrate vigorous twisting of the arms and shoulders suggesting the requirement for upper body strength.

Figure 2:
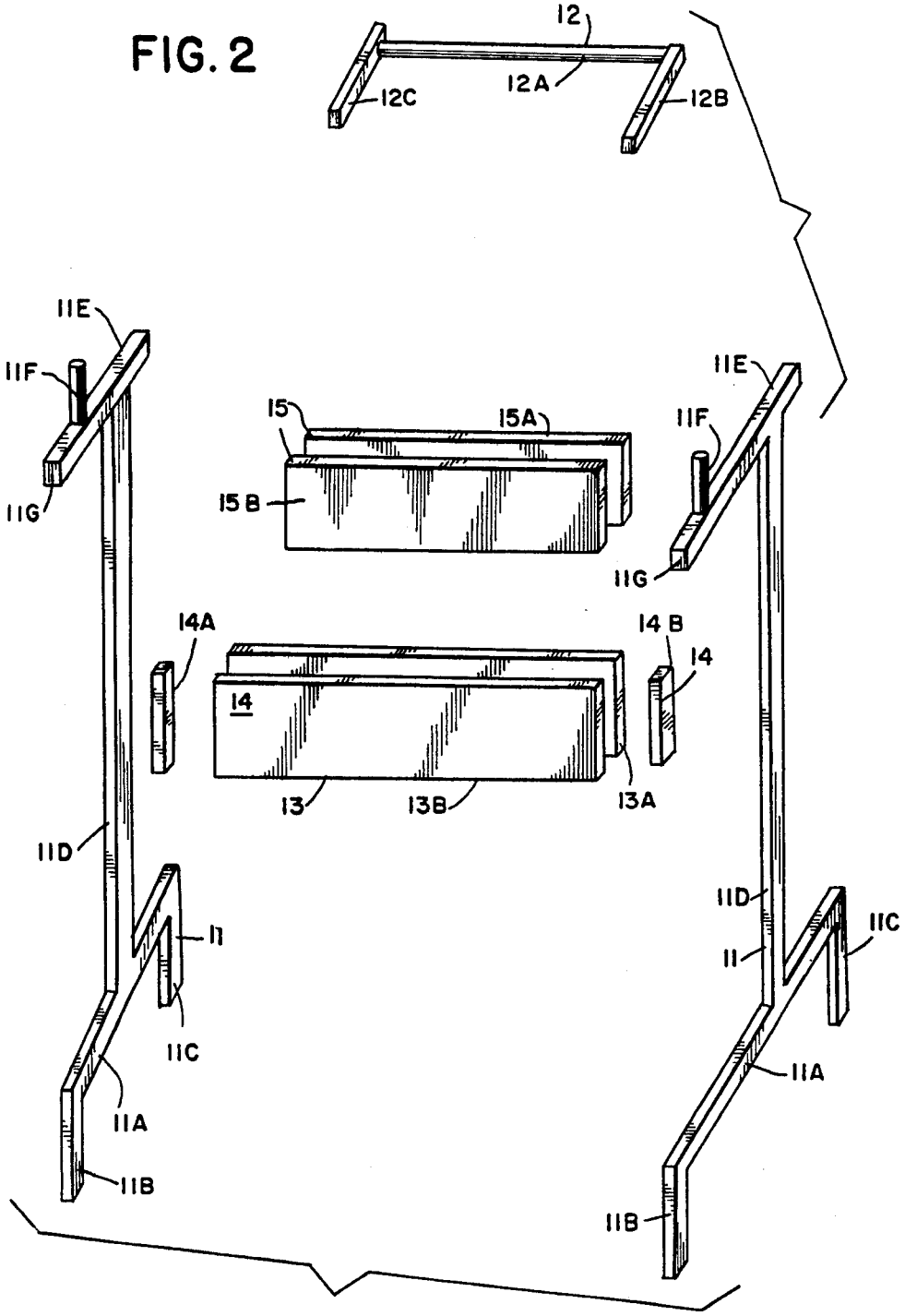
FIG. 2 shows an exploded view of the parts of the dissembled apparatus which may be packaged in a flat container for economy in shipping and storing.

FIG. 2 shows the parts of the dissembled apparatus of this invention. Two general "H" shaped side frames are presented as weldments of rectangular tube. Each of the two frames 11 is comprised of several components. Thus looking for the moment at the "H-shaped" rightmost frame (the left frame is identical to the right frame) extensions 11*b* and 11*c* protrude substantially perpendicularly from bar 11*a* (shown as horizontal in FIG. 2 when the apparatus is shown in an exploded view in FIG. 2 in the erected position) and support the apparatus on the floor when the apparatus is used in the erected or vertical position. When the apparatus is used in the prone or horizontal position as shown, for example, in FIG. 3, the portion 11*a* will be vertical. Member 11*d* is welded to member 11*a* and to member 11*e* such that members 11*a* and 11*e* are substantially parallel and form with member 11*d* an approximate "H" shape with the cross-bar 11*d* connecting parallel members 11*a* and 11*e* at points closer to one end than the other. Member 11*e* is oriented such that the end 11*g* of member 11*e* will be in the same plane as the end surface of member 11*b*. Thus when the apparatus is placed in the prone position as shown in FIG. 3, portions 11*b* and end 11*g* of member of 11*e* serve to support the structure. Handle 11*f* is placed on member 11*e* a selected distance (typically a few inches) from face 11*g*. The actual placement of handle 11*f* can be determined by experiment and is not critical although handle 11*f* should be closer to end 11*g* than to the other end of member 11*e*. Member 11*e* is substantially parallel to member 11*a* whereas member 11*d* is substantially perpendicular to members 11*e* and 11*a*. If desired, member 11*d* can be somewhat angled relative to members 11*e* and 11*a* or slightly curved if desired. However, as will be seen shortly, the orientation of member 11*d* may affect the ease with which the exercises contemplated to be done on this machine can be carried out.

An end bar, 12 is shown as consisting of a one inch diameter circular-cross-sectioned bar (12*a*) welded to short lengths of rectangular tube at each end. Bar 12*a* is preferrably round to allow ease of grasping by hand but can be other shapes if desired. Two padded end panels 15*a* and 15*b* are also shown.

End panels 15*a* and 15*b* will, as be shown shortly, support the back and legs of a user when the apparatus is used in the manner to be described shortly, for exercising. These panels also are bolted or otherwise joined to the two frames 11 and thus provide support for the structure and prevent the left and right frames 11 from coming together or spreading apart while exercises are being conducted on the apparatus. Each of these panels is typically 12"×30" and 1" or 2" thick. These panels are padded for comfort in use.

Figure 6:
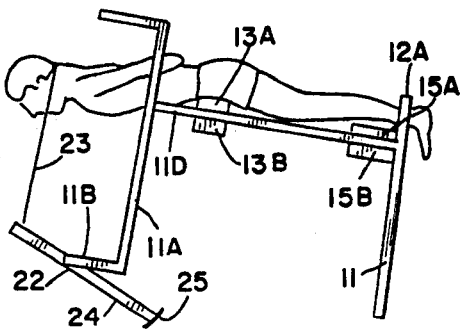
FIG. 6 shows the apparatus in the prone position with lever arm attached.

The sliding seat is seen to consist of two panels 13*a* and 13*b* and two separators, 14*a* and 14*b*. The sliding seat comprised of two panels 13*a* and 13*b* is mounted over the extensions 11*a* of frames 11 as shown in FIG. 3. As shown in FIG. 3 the sliding seat panels 13 are separated from each other by spacers 14*a* and 14*b* such that seat panels 13*a* and 13*b* will slide along members 11*a*. FIG. 6 illustrates one use of seat panels 13*a* and 13*b* wherein a person exercising on the apparatus in the prone position is able to move his or her chest pivoting about the waist in the vertical direction in a manner to be described shortly and wherein the seat panels 13*a* and 13*b* are slideably located along arms 11*a* in the proper position for the size of the person using the apparatus or to change the leverage of the lift. The operation of the structure shown in FIG. 6 will be described shortly.

Figure 5:
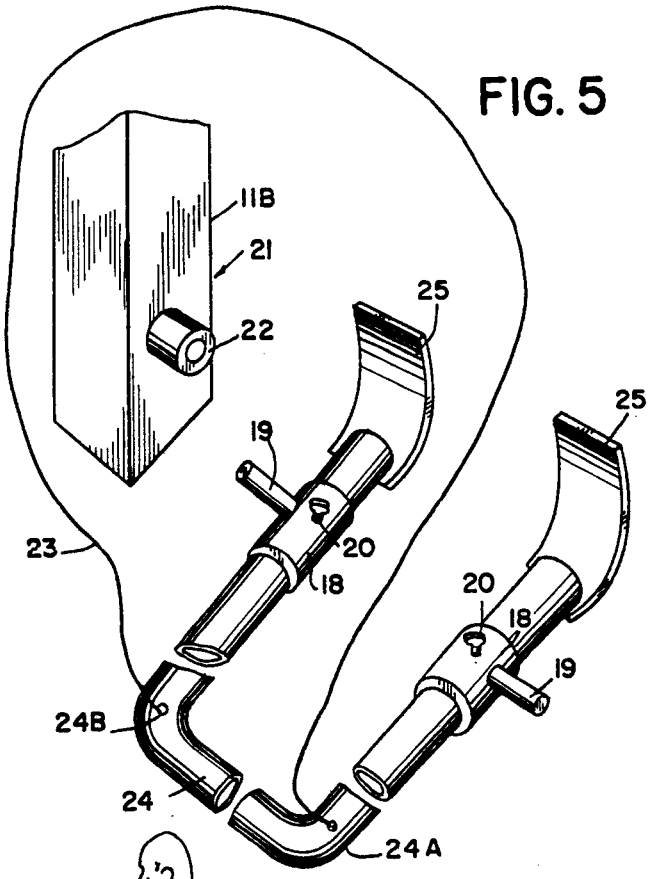
FIG. 5 shows a lever arm which may be attached to the apparatus to provide adjustable resistance.
Figure 7:
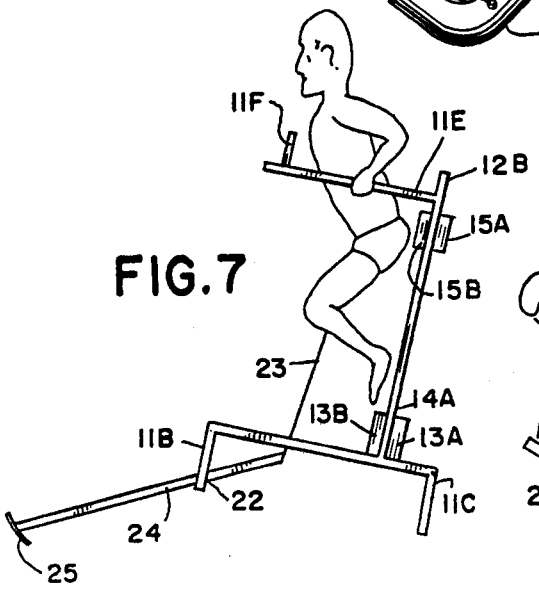
FIGS. 7 and 8 show the apparatus in the erect position with the lever arm attached.
Figure 8:
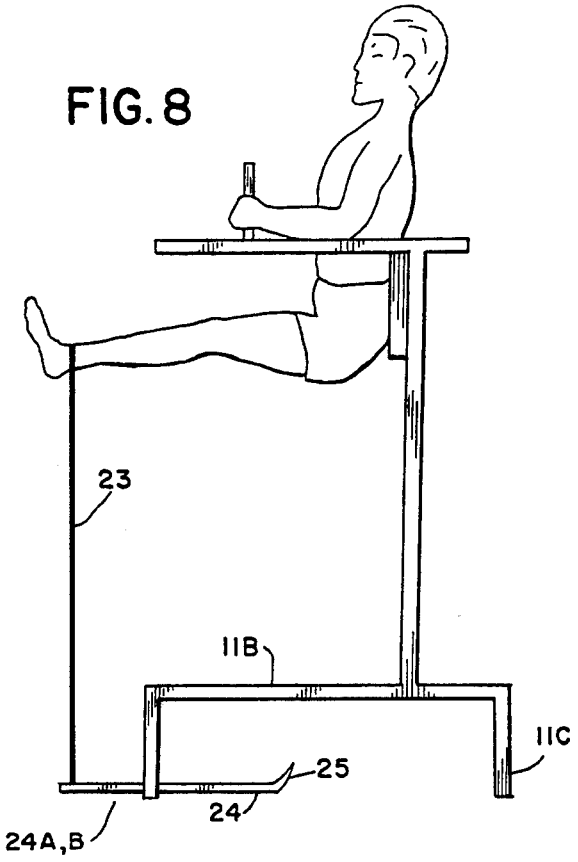

A lever arm subassembly shown in FIG. 5 provides means for imposing adjustable resistance to the exercise motion. The structure shown in FIG. 5 comprises two levers suitable for being rotatably mounted on the ends 11*b* of frames 11 as shown in FIGS. 6, 7 and 8 so as to provide to the user an exercise which can be varied depending upon the strength and experience of the user. As shown in FIGS. 5 and 6 together, a rotatable end 25 (known as a "shoe") is mounted on the end of shaft 24. Shaft 24 is rotatably mounted on arm 11*b* attached to frame 11. Because arm 11*b* normally rests on the floor when the apparatus is either erect or prone, the shaft 24 is normally approximately horizontal when the apparatus is at rest. Shaft 24 rotatably moves about pivot point 22 and is connected to a bearing support 22 (FIG. 5) so as to be rotatable. A user lies on the apparatus by placing his thighs on seat 13*a*. Seat 13*a* is adjusted to control the amount of effort which is required for the athlete to raise his or her torso from the rest position to a horizontal position. A strap 23 is then placed around the neck of the exerciser. The ends of strap 23 are attached to lever 24 at selected points 24*a* and 24*b* determined to control the amount of effort required to lift. By varying the pivot point 22 (this point is easily adjustable by sliding collars 18 along arm 24 and tightening set screws 20 when collars 20 are properly located) on lever arm 24 as well as the point on which strap 23 is attached to lever arm 24, the user can control the amount of effort required to raise arm 11*b* off the floor merely through the raising of his or her torso from the rest position to the horizontal position. The lever arm can also be used when the apparatus is set in the vertical position as shown in FIG. 4 by attaching the strap to the thigh of one's leg or waist and then raising one's waist and thigh while holding on to the proper portion of the apparatus thereby to rotate the lever arm and raise the apparatus from the floor. This usage is shown in FIGS. 7 and 8.

In FIG. 3 is shown the apparatus assembled from the parts of FIG. 2 and standing in the prone position. It is observed that the two side frames 11 are held together by bolting to the end bar 12 and fixed padded end panels 5*a* and 15*b*. If the side frames are constructed of tubing (rectangular or round) then supports 12*b*, 12*c* of the end bar 12*a* may telescope into each side frame 11 such that the height of the end bar 12*a* above the sliding seat and end panel is adjustable as shown in FIG. 3. The distance from the end bar 12*a* to the sliding seat 13*a*, 13*b* is adjustable.

To exercise the hamstring and buttocks in the desired range of motion, the performer lies with the sliding seat at waist position and his heels hooked under the end bar 12*a*. To perform the exercise the performer straightens his hips, thereby lifting his upper body. It is obvious that in the performance of this exercise, the greatest strain is on the hamstrings when the hips are nearly straight as desired for greatest benefit to sprinters.

In order to exercise the lower abdomen the performer sits on the adjustable seat 13*a* and 13*b* and hooks his toes under the end bar 12*a*. Then he leans back as far as possible so that his back is arched and his shoulders approach the floor. The performer then draws himself up toward a sitting position. Performing this situp with the back arched and the shoulders lowered, maximum stress is imposed on the lower abdominal muscles in the range of motion where great strain is imposed by sprinting. This exercise is excellent for preventing soreness in the groin which is common to sprinters.

FIG. 4 shows the apparatus in the erect position. It is seen that the performer may stand so as to grasp hand bars 11*f* in each hand with his back against the fixed padded end panel 15*b*. His elbows are resting on the side rails 11*e*. He may lift one or both legs in order to exercise the quardiceps and abdomen in the desired range of motion for sprinters. The objective is to develop strength to pull the knees high.

In order to develop upper body strength, three exercises may be performed with the apparatus in the erect position. The first is performed by kneeling at the rear of the erect apparatus, grasping the end bar 12*a* with both hands and performing pullups. This exercise develops the biceps and upper back. The second exercise is performed by placing both hands on the side rails 11*e* and then pushing oneself up by straightening the arms. This exercise develops the triceps and pectorals (muscles of the chest). In the third exercise, the performer performs a head stand with his head on the floor and a hand on each lower side rail. His body is inverted with his feet resting on the end panel 15*b*. Then he pushes himself to a hand stand position by straightening his arms. This exercise develops the trapezius and deltoids (shoulders) and the triceps.

In FIG. 5 is shown a lever arm assembly which may be attached to the apparatus and used to impose a variable resistance to the motion of the exercise with the apparatus in either the erect or prone position. The lever arm assembly is seen to consist of a short tee section 20 formed by a short pipe fastened at its middle to the end of a short bar 19. The lever, 20, a U-shaped structure, slides into the tee where its position is adjustable and clamped by screws, 20. The lever is seen to be attached to the lower end of a leg, 21, of the apparatus close to the floor and opposite the end rail 12*a*. Through a bearing, 22, the operation of the attachment is illustrated in FIG. 6 wherein it is seen that in the performance of either the hipthrust or the arched situp, the performer may loop a cable, 23, attached to the lever arm, 24, about his or her neck such that, in the course of the performance of the exercise, the cable is pulled, causing the lever arm to turn about its pivot point. This causes the lever arm to lift one end of the apparatus and the performer, thereby imposing resistance. The resistance can be adjusted by adjusting the position of the adjustable seat 13*a* and 13*b*, and the point of attachment of the cable to the lever arm. The lever arm is fitted with two shoes, 25, whose shape is such that as the lever arm is turned, during the exercise, the point of contact between floor and shoe moves along the shoe. By this means, it is seen that the leverage (distance between point of contact with the floor and axis of turning) is changed so that the resistance throughout the entire range of motion is determined by the shape of the shoe.

By rotating the shoes on each lever arm, the lever arm assembly may be used with the apparatus in either the erect or prone position. When used in the erect position (as shown in FIGS. 7 and 8), the performer may attach the cable to his waist (to perform dips) or loop the cable about his knee to perform leg raises. If one realizes that some performers perform dips and situps with as much as 150 pounds, and weights presently are quite expensive and sold by the pound, then the convenience and economy of the leverage assembly is apparent.

It should be emphasized that, in any exercise, there is a range where resistance to motion is greatest. One feature of this invention is that with this apparatus, the major exercises intended to develop strength for sprinting may be performed wherein the maximum resistance is encountered in the range where the stress of sprinting is greatest.

Another feature of this invention is that through the use of a sliding seat and lever arm assembly the resistance can be imposed and adjusted in the desired range of motion.

A third feature of this invention is that the apparatus in its dissembled form, may be packaged in a flat compact container.

The above description is intended to be illustrative only and not limiting. In view of the above description, other embodiments of this invention will be obvious to those skilled in the exercise arts.

I claim:

1. Exercise apparatus comprising;

two identical frames, each frame having a substantial "H-shape" with a relatively short member extending from each of the two ends of one of the vertical members of the "H" substantially parallel to the cross-piece forming the center of the "H-shaped" frame attaching one vertical member of the "H-shaped" frame to the other vertical member of the "H-shaped" frame and in a direction away from said other vertical member, the two relatively short members on each "H-shaped" frame forming four support legs for said structure when said structure is mounted in a vertical position;

spacer means holdng one frame spaced relative to the other frame, said spacer means comprising padded members suitable for serving as a seat or a rest for a user;

a hand-grip means extending from the other vertical member of the "H-shaped" frame substantially parallel to the cross-piece and in a direction away from the one vertical member of each "H-shaped" frame;

a sliding support means located to slide along the cross-section member of each "H-shaped" frame so as to adjustably support a user;

whereby said two "H-shaped" frames are assembled relative to each other so that said apparatus can be mounted such that four support legs are vertical in one configuration and horizontal in a second configuration and wherein said four support legs hold said apparatus when said apparatus is in the vertical position and wherein two of said four support legs serve together with one end of the other vertical members of said "H-shaped" frames to support said structure when it is in the horizontal position.

2. Structure as in claim 1 wherein the structure includes:

means for restraining a user's feet extending from said frames at a location adjacent said spacer means member such that a user is capable of locking his feet beneath said means for restraining and above said spacer means when said apparatus is horizontal and is capable of using said means for restraining a user's feet for a handhold when said apparatus is vertical.

3. Structures in claim 1 wherein said sliding support member is slideably movable along the cross-sections of each of said "H-shaped" frame members to adjust the structure to allow the user to adjust the leverage obtained during exercises.

4. Structure as in claim 1 including a pair of levers rotatably mounted one on each of a selected one of two support legs such that one end of each lever is in contact with the floor, the other end of each lever is connectable by a strap over a user's shoulders or other part of the user's anatomy such that when the user rotates his body and lifts on the strap, the apparatus is lifted from the floor by the rotation of the lever.

5. Structure as in claim 1 wherein each of said four support legs are removed.

6. An exercise structure for use by a user in performing/exercises, said exercise structure comprising:

a first support means for supporting said exercise structure in a first prone position of exercise structure orientation;

a second support means for supporting said exercise structure in an alternate second position of exercise structure orientation substantially perpendicular to said first position; and means, connected to said exercise structure, for restraining the feet of a user when said exercise structure is in said first position, said means for restraining functioning to receive the hands of a user performing pull-up exercises when said exercise structure is in said second position; and means, connected to said exercise structure, for restraining the thighs of the user when said exercise structure is in said first position said means for restraining the thighs being adjustable in location relative to said means for restraining the feet so that the user may perform exercises involving extreme bending of the user's torso.

7. Exercise structure as described in claim 6 wherein said means for restraining the thighs comprises a seat whose distance from said means for restraining the feet is adjustable, said seat being located so as to permit extreme bending of the user's torso when the user lies on the seat with the user's feet restrained by said means for restraining the feet.

8. Exercise structure as described in claim 6 wherein said first support means function to receive the arms or hands of the user when said exercise structure is in said second position so that the user may rest his arms or hands on said support means to perform a number of exercises including leg raises or dips.

9. Exercise structure as in claim 8 further comprising hand grip means, attached to said first support means, for receiving the hands of the user when said exercise structure is oriented in said second position.

10. Exercise structure as in claim 6 further comprising a pair of levers which are rotatably mountable at pivot points located on said first support means such that one end of each lever is in contact with the floor, and the other end of each lever is connectable by a strap over a portion of the user's anatomy such that when the user rotates his body and lifts on the strap an additional resistance is imposed.

11. Exercise structure as in claim 10 wherein said structure may be dissembled into flat parts for storage.

* * * * *